US006426156B2

(12) United States Patent
Fujino

(10) Patent No.: US 6,426,156 B2
(45) Date of Patent: Jul. 30, 2002

(54) MAGNETOSTATIC WAVE DEVICE

(75) Inventor: Masaru Fujino, Otsu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/772,438

(22) Filed: Jan. 30, 2001

Related U.S. Application Data

(62) Division of application No. 09/304,023, filed on May 3, 1999, now abandoned.

(30) Foreign Application Priority Data

May 22, 1998 (JP) ..... 10-158474

(51) Int. Cl.[7] ..... H01P 3/00; H01P 11/00; H01F 10/24

(52) U.S. Cl. ..... 428/692; 428/693; 428/700; 428/701; 428/900; 252/62.51; 252/62.56; 252/62.57; 333/147; 333/158; 333/202

(58) Field of Search ..... 428/692, 693, 428/700, 701, 900; 252/62.51, 62.56, 62.57; 333/147, 158, 202

(56) References Cited

U.S. PATENT DOCUMENTS 4,273,610 A 6/1981 Glass et al.

FOREIGN PATENT DOCUMENTS

JP 02-126714 * 5/1990
JP 07-335438 * 12/1995

OTHER PUBLICATIONS

French Preliminary Search Report issued Feb. 27, 2002.
W. Hongxu et al., "The Growth of LPE YIG Films With Narrow FMR Linewidth", IEEE TRANSACTIONS ON MAGNETICS, vol. 20, No. 5, Sep. 1984, pp. 1222–1223, XP002191555.
Database WPI, Section Ch, Week 199046, Derwent Publications Ltd., London, GB, Class J04, AN 1990–344615, XP002191556.

* cited by examiner

*Primary Examiner*—Stevan A. Resan
(74) *Attorney, Agent, or Firm*—Ostrolenk, Faber, Gerb & Soffen, LLP

(57) ABSTRACT

A magnetic garnet single crystal film used for a magnetostatic wave device has a Pb content in the range of from more than zero to about 4,000 ppm by weight.

4 Claims, 1 Drawing Sheet

MAGNETOSTATIC WAVE DEVICE

This is a division of application Ser. No. 09/304,023, filed May 3, 1999 now abandoned.

BACKGROUND OF THE INVENTION

1. Field of the Invention

The present invention relates to a magnetic garnet single crystal film, a method for manufacturing the magnetic garnet single crystal film, and a magnetostatic wave device having the magnetic garnet single crystal film, and more particularly to magnetic garnet single crystal film and the like which are used for a magnetostatic wave device such as a limiter, a noise filter, or the like.

2. Description of the Related Art

A $Y_3Fe_5O_{12}$ (YIG) single crystal film is an important substance used as a magnetic garnet single crystal film for a magnetostatic wave device. Particularly, the YIG single crystal film is excellent due to an extremely narrow ferromagnetic half-width ($\Delta H$). When the YIG single crystal film is applied to the magnetostatic wave device, this characteristic can make the difference between an input signal and an output signal small. Furthermore, another characteristic of the YIG single crystal film is that a saturation phenomenon occurs at a relatively small electric power compared with the input signal. The YIG single crystal film is widely used for magnetostatic wave devices such as a limiter and a noise filter which utilize the aforementioned characteristics.

A magnetic garnet single crystal film including a Fe element other than the YIG single crystal film is also applied to the magnetostatic wave device in a manner similar to that of the YIG single crystal film.

Although the magnetic garnet single crystal film has the excellent properties as explained above, the conventional magnetic garnet single crystal film also has the drawbacks. Specifically, a large insertion loss, long transient response time, and high saturated input power impair the aforementioned properties in applying the magnetic garnet single crystal film to magnetostatic wave devices. These characteristics are especially important for microwave device use.

SUMMARY OF THE INVENTION

It is therefore an object of the present invention to provide a magnetic garnet single crystal film which can produce a higher performance magnetostatic wave device.

Another object of the present invention is to provide a method for manufacturing the magnetic garnet single crystal film which can produce the higher performance magnetostatic wave device.

Further object of the present invention is to provide a higher performance magnetostatic wave device.

The magnetic garnet single crystal film used for a magnetostatic wave device, according to the present invention, contains Pb in the range from more than zero to not more than about 4,000 ppm by weight. The method for manufacturing the magnetic garnet single crystal film in accordance with the present invention comprises the step of growing the magnetic garnet single crystal film by liquid phase epitaxy using a PbO-based flux at a temperature of not less than about 940° C. Alternatively, the growing step may be performed by liquid phase epitaxy using a PbO-based flux having a content of a Pb compound of not more than about 70 percent by weight in terms of PbO content.

The magnetostatic wave device in accordance with the present invention includes Pb at a content of more than zero and not more than about 4,000 ppm by weight.

Thus, the present invention makes it possible to prevent insertion loss, and increases transient response time and saturated input electrical power with respect to a magnetostatic wave device using the magnetic garnet single crystal film.

For the purpose of illustrating the invention, there is shown in the drawing a form which is presently preferred, it being understood, however, that the invention is not limited to the precise arrangement and instrumentality shown.

BRIEF DESCRIPTION OF THE DRAWING

The sole FIGURE is an isomeric view of a magnetostatic wave device according to an example of the present invention.

DETAILED DESCRIPTION OF PREFERRED EMBODIMENTS

Figure 1:
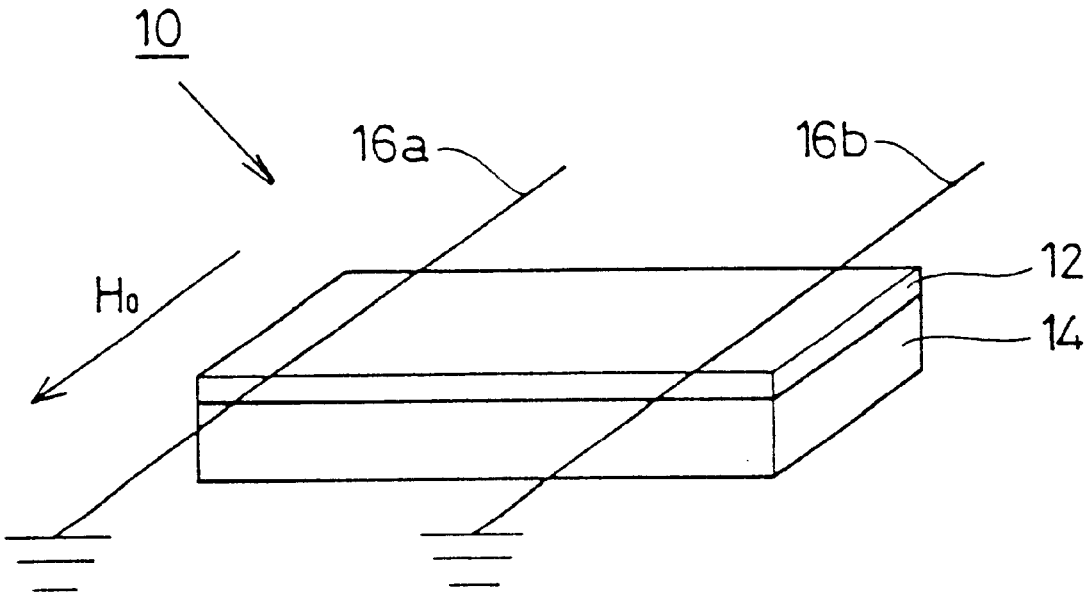

The inventor of the present invention have been studied the improvement of the magnetic garnet single crystal film, and first found that lead contained in the magnetic garnet single crystal film as an impurity adversely affects the insertion loss, transient response time and saturated input power.

The conventional magnetic garnet single crystal film has been grown by a liquid phase epitaxial method using a PbO-based flux since the PbO melts at a relatively low temperature to yield a molten PbO which is stable and has a low viscosity. These features are important to grow an excellent magnetic garnet single crystal film, but it was found by the inventor that the Pb in the Pbo flux is adversely included in the obtained magnetic garnet single crystal film during the crystal growth. According to the inventor's further study, it is thought that Pb exists in the form of $Pb^{2+}$ or $Pb^{4+}$ in the obtained magnetic garnet single crystal film and that the $Pb^{2+}$ or $Pb^{4+}$ reduces $Fe^{3+}$ to $Fe^{2+}$, thereby degrading the insertion loss, transient response time and saturated input power.

It is true that a lead-free magnetic garnet single crystal film can be grown by employing a lead-free flux, but it is impossible to grow a magnetic garnet single crystal film having an excellent crystallinity without using PbO.

In view of the foregoing, the inventor found the novel magnetic garnet single crystal film which can be grown by employing a flux and a method to grow the novel magnetic garnet single crystal film. According to the present invention, the magnetic garnet single crystal film used for a magnetostatic wave device comprises Pb in the range from more than zero to about 4,000 ppm by weight. When the content amount of the Pb is limited to about 4,000 ppm by weight or less, the magnetic garnet single crystal film has excellent characteristics in insertion loss, transient response time and saturated input power.

It has been found possible to limit the amount of Pb in the film by controlling the temperature or the PbO content of the flux, or both.

The garnet single crystal film having Pb at about 4,000 ppm by weight or less can be grown by liquid phase epitaxy using a PbO-based flux at a temperature of not less than about 940° C. Conventionally, it has been thought that it is preferable to grow the garnet single crystal film at a low temperature so as to improve the crystallinity of the garnet single crystal film. This is consistent with the reason to employ the Pbo flux. However, as will be explained later, it has been found by the inventor that the amount of contamination of the Pb decreases as the growing temperature increases and the amount of contamination decreases drastically. As the temperature is increased above 940° C., it may be appropriate to lower the Pb content in the flux.

Alternatively, the liquid phase epitaxy is performed using a PbO-based flux having a content of a Pb compound of not more than about 70 percent by weight in terms of PbO content. It has been also found that the amount of contamination of the Pb decreases as the growing temperature increases and that, if the content of a Pb compound is not more than about 70 percent, the amount of contamination of the Pb decreases drastically. A growing temperature below 940° C. can be employed if the PbO content is appropriately low.

Hereinafter, the preferred embodiments of the present invention are explained in detail with reference to the drawings.

The FIGURE is an perspective view of a magnetostatic wave device according to an example of the present invention. There is provided a magnetostatic wave device 10 which includes a magnetic garnet single crystal film 12. The magnetic garnet single crystal film 12 is formed on one of main surfaces of a $Gd_3Ga_5O_{12}$ substrate 14. Two transducers 16*a* and 16*b* made of metal wires are spaced parallel to each other on the magnetic garnet single crystal film 12. One terminal of the transducer 16*a* is connected to an input terminal (not shown) and the other terminal is grounded. In addition, a direct current magnetic field is applied to the magnetostatic wave device 10 in a direction parallel to the main surface of the magnetic garnet single crystal film 12, and in a direction parallel to the transducers 16*a* and 16*b*, that is, in the direction indicated by the arrow $H_0$ in the FIGURE.

EXAMPLE 1

A $Gd_3Ga_5O_{12}$ substrate was used as a substrate for forming a magnetic garnet single crystal film by liquid phase epitaxy. Next, $Fe_2O_3$, $Y_2O_3$, PbO and $B_2O_3$ were provided as raw materials at amounts of 7.5 percent by weight, 0.5 percent by weight, 90.0 percent by weight and 2.0 percent by weight, respectively. Then, the raw materials were mixed, filled in a platinum crucible retained in a vertical electric furnace, homogenized at a temperature of 1,200° C. and melted. The melt was retained at a constant growth temperature ranging from 930 to 950° C. shown in Table 1, so that garnet was supersaturated. Then, the $Gd_3Ga_5O_{12}$ substrate was dipped and rotated for a predetermined time. Then, the $Gd_3Ga_5O_{12}$ substrate was lifted from the melt and rotated at a high speed so that the attached melt on the magnetic garnet single crystal film was shaken off by centrifugal force.

Thus, a $Y_3Fe_5O_{12}$ magnetic garnet single crystal film with a thickness of about 10 $\mu$m was formed.

Magnetostatic wave devices 10 shown in the FIGURE were produced using the obtained magnetic garnet single crystal films, and insertion losses, transient response time, and saturated input electrical power were measured. In addition, the Pb content in the obtained magnetic garnet single crystal films (Pb content in the films) were measured. The results are shown in Table 1. In Table 1, samples in which an asterisk * is attached to the sample number are not included within the scope of the present invention and the others are included within the scope of the present invention.

TABLE 1

| Sample No. | Growth Temperature (° C.) | Pb content in film (ppm by weight) | Insertion loss (dB) | Transient response time (ns) | Saturated input power (dBm) |
|---|---|---|---|---|---|
| 1* | 930 | 6200 | 16 | 330 | −17 |
| 2* | 935 | 5800 | 14 | 290 | −18 |
| 3 | 940 | 3900 | 9 | 180 | −25 |
| 4 | 945 | 2100 | 7 | 170 | −26 |
| 5* | 950 | No formation of YIG single crystal film | | | |

As shown in Table 1, the samples No.1, No. 2 and No. 5 which are not included within the scope of the present invention could not produce magnetostatic wave devices with small insertion losses, short transient response time, and low saturated input power, or could not form a magnetic garnet single crystal film (a YIG single crystal film). In contrast, samples No. 3 and No. 4 which are included within the scope of the present invention could produce magnetostatic wave devices with light insertion losses, short transient response time and low saturated input electrical power.

EXAMPLE 2

A $Gd_3Ga_5O_{12}$ substrate was used as a substrate for forming a magnetic garnet single crystal film by liquid phase epitaxy. Next, $Fe_2O_3$, $Y_2O_3$, and $B_2O_3$ were provided as raw materials at amounts of 7.5 percent by weight, 0.5 percent by weight and 2.0 percent by weight, respectively, and PbO and $MoO_3$ were provided as shown in Table 2. Then, all raw materials were mixed, filled in a platinum crucible retained in a vertical electric furnace, homogenized at a temperature of 1,200° C. and melted. The melt was retained at a temperature of 920° C., so that garnet was supersaturated. Then, the $Gd_3Ga_5O_{12}$ substrate was dipped and rotated for a predetermined time. Then, the $Gd_3Ga_5O_{12}$ substrate was lifted from the melt and rotated at a high speed so that the attached melt on the magnetic garnet single crystal film was shaken off by centrifugal force. Thus, a $Y_3Fe_5O_{12}$ magnetic garnet single crystal film with a thickness of about 10 $\mu$m was formed.

Magnetostatic wave devices 10 shown in the FIGURE were produced using the obtained magnetic garnet single crystal films, and insertion losses, transient response time, and saturated input electrical power were measured. In addition, the Pb content in the obtained magnetic garnet single crystal films (Pb content in the films) were measured. The results are shown in Table 2. In Table 2, samples in which an asterisk * is attached to the sample number are not included within the scope of the present invention and the others are included within the scope of the present invention.

TABLE 2

| Sample No. | Pb content (percent by weight) | $MoO_3$ content (percent by weight) | Pb content in film (ppm by weight) | Insertion loss (dB) | Transient response time (ns) | Saturated input power (dBm) |
|---|---|---|---|---|---|---|
| 6* | 90 | 0 | 8400 | 22 | 390 | −14 |
| 7* | 80 | 10 | 6700 | 18 | 300 | −17 |
| 8 | 70 | 20 | 3500 | 10 | 190 | −25 |
| 9 | 60 | 30 | 3100 | 8 | 160 | −27 |

As shown in Table 2, the samples No. 6, and No. 7 which are not included within the scope of the present invention could not produce magnetostatic wave devices with light insertion losses, short transient response time, and low saturated input electrical power. In contrast, the samples No. 8 and No. 9 which are included within the scope of the present invention could produce magnetostatic wave devices with light insertion losses, short transient response time, and low saturated input electrical power.

EXAMPLE 3

A $Gd_3Ga_5O_{12}$ substrate was used as a substrate for forming a magnetic garnet single crystal film by liquid phase epitaxy. Next, $Fe_2O_3$, $Y_2O_3$, $La_2O_3$, $Ga_2O_3$ and $B_2O_3$ were provided as raw materials at amounts of 7.0 percent by weight, 0.5 percent by weight, 0.1 percent by weight, 0.4 percent by weight and 2.0 percent by weight, respectively, and PbO and $MoO_3$ were provided as shown in Table 3. Then, all raw materials were mixed, filled in a platinum crucible retained in a vertical electric furnace, homogenized at a temperature of 1,200° C. and melted. The melt was retained at a temperature of 900° C., so that garnet was supersaturated. Then, the $Gd_3Ga_5O_{12}$ substrate was dipped and rotated for a predetermined time. Then, the $Gd_3Ga_5O_{12}$ substrate was lifted from the melt and rotated at a high speed so that the attached melt on the magnetic garnet single crystal film was shaken off by centrifugal force. Thus, a $(Y, La)_3(Fe, Ga)_5O_{12}$ magnetic garnet single crystal film with a thickness of about 10 $\mu$m was formed.

Magnetostatic wave devices 10 shown in the FIGURE were produced using the obtained magnetic garnet single crystal films, and insertion losses, transient response time and saturated input electrical power were measured. In addition, the Pb content in the obtained magnetic garnet single crystal films (Pb content in the films) were measured. The results are shown in Table 3. In Table 3, samples in which an asterisk * is attached to the sample number are not included within the scope of the present invention and the others are included within the scope of the present invention.

TABLE 3

| Sample No. | Pb content (percent by weight) | $MoO_3$ content (percent by weight) | Pb content in film (ppm by weight) | Insertion loss (dB) | Transient response time (ns) | Saturated input power (dBm) |
|---|---|---|---|---|---|---|
| 10* | 90 | 0 | 8900 | 24 | 330 | −19 |
| 11* | 80 | 10 | 7200 | 19 | 280 | −20 |
| 12 | 70 | 20 | 3900 | 10 | 180 | −28 |
| 13 | 60 | 30 | 3000 | 9 | 160 | −29 |

As shown in Table 3, samples No. 10, and No. 11 which are not included within the scope of the present invention could not produce magnetostatic wave devices with light insertion losses, short transient response time, and low saturated input electrical power. In contrast, samples No. 12 and No. 13 which are included within the scope of the present invention could produce magnetostatic wave devices with light insertion losses, short transient response time, and low saturated input electrical power.

EXAMPLE 4

A $Gd_3Ga_5O_{12}$ substrate was used as a substrate for forming a magnetic garnet single crystal film by liquid phase epitaxy. Next, $Fe_2O_3$, $Y_2O_3$, and $B_2O_3$ were provided as raw materials at amounts of 7.5 percent by weight, 0.5 percent by weight and 2.0 percent by weight, respectively, and PbO, $PbF_2$ and $MoO_3$ were provided as shown in Table 4. Then, all raw materials were mixed, filled in a platinum crucible retained in a vertical electric furnace, homogenized at a temperature of 1,200° C. and melted. The melt was retained at a temperature of 910° C., so that garnet was supersaturated. Then, the $Gd_3Ga_5O_{12}$ substrate was dipped and rotated for a predetermined time. Then, the $Gd_3Ga_5O_{12}$ substrate was lifted from the melt, and rotated at a high speed so that the attached melt on the magnetic garnet single crystal film was shaken off by centrifugal force. Thus, a $Y_3Fe_5O_{12}$ magnetic garnet single crystal film with a thickness of about 10 $\mu$m was formed.

Magnetostatic wave devices 10 shown in the FIGURE were produced using the obtained magnetic garnet single crystal films, and insertion losses, transient response time and saturated input electrical power were measured. In addition, the Pb content in the obtained magnetic garnet single crystal films (Pb content in the films) were measured. The results are shown in Table 4. In Table 4, samples in which an asterisk * is attached to the sample number are not included within the scope of the present invention, and the others are included within the scope of the present invention.

TABLE 4

| Sample No. | PbO content (percent by weight) | $PbF_2$ content (percent by weight) | $MoO_3$ content (percent by weight) | Pb content in film (ppm by weight) | Insertion loss (dB) | Transient response time (ns) | Saturated input power (dBm) |
|---|---|---|---|---|---|---|---|
| 14* | 85 | 5 | 0 | 6400 | 23 | 300 | −16 |
| 15* | 75 | 5 | 10 | 6000 | 20 | 260 | −17 |
| 16 | 65 | 5 | 20 | 2100 | 9 | 200 | −25 |
| 17 | 55 | 5 | 30 | 1800 | 7 | 170 | −27 |

As shown in Table 4, samples No. 14, and No. 15 which are not included within the scope of the present invention could not produce magnetostatic wave devices with light insertion losses, short transient response time and low saturated input electrical power. In contrast, samples No. 16 and No. 17 which are included within the scope of the present invention could produce magnetostatic wave devices with light insertion losses, short transient response time and low saturated input electrical power.

As described above with reference to the examples in accordance with the present invention, it is clear that reducing Pb concentration in the magnetic garnet single crystal film to about 4,000 ppm by weight or less makes it possible for an insertion loss to be not more than 10 dB, transient response time to be not more than 200 ns and saturated input electrical power to be not more than −25 dBm.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A magnetostatic wave device comprising a magnetic garnet single crystal film having a Pb content in the range of from more 1,800 to about 4,000 ppm by weight and a substrate.

2. A magnetostatic wave device according to claim 1, wherein said magnetic garnet single crystal film further comprises Fe.

3. A magnetostatic wave device according to claim 2, wherein said magnetic garnet single crystal film is a liquid phase epitaxy magnetic garnet single crystal film.

4. A magnetostatic wave device according to claim 1, wherein said magnetic garnet single crystal film is a liquid phase epitaxy magnetic garnet single crystal film.

* * * * *